United States Patent [19]

Lindelöv et al.

[11] 3,988,984

[45] Nov. 2, 1976

[54] PRINTING DEVICE COMPRISING A DISTANCE ROLLER

[75] Inventors: Ernst Claes Goran Lindelöv; Björn Sven Hilding Eriksson, both of Jarfalla, Sweden

[73] Assignee: U.S. Philips Corporation, New York, N.Y.

[22] Filed: Nov. 3, 1975

[21] Appl. No.: 628,091

[30] Foreign Application Priority Data

Nov. 6, 1974 Sweden ..... 74138892

[52] U.S. Cl. ..... 101/93.03; 101/93.15

[51] Int. Cl.[2] ..... B41J 9/26

[58] Field of Search ..... 101/212, 93.03, 93.15, 101/93.16, 93.17; 197/149

[56] References Cited

UNITED STATES PATENTS

| | | | |
|---|---|---|---|
| 3,090,297 | 5/1963 | Wilkins et al. | 101/93.03 |
| 3,135,195 | 6/1964 | Potter | 101/93.16 X |
| 3,461,235 | 8/1969 | Willcox et al. | 101/93.15 X |
| 3,651,914 | 3/1972 | Locke | 101/93.16 X |

FOREIGN PATENTS OR APPLICATIONS

| | | | |
|---|---|---|---|
| 2,057,923 | 6/1972 | Germany | 101/93.15 |

*Primary Examiner*—E. H. Eickholt
*Attorney, Agent, or Firm*—Frank R. Trifari; David R. Treacy

[57] ABSTRACT

A printing device having a printing head opposite a cylindrical anvil. The printing head is displaceable along a guide rod which is connected by pivotable arms to a pressure roller which is spring-biased against the anvil. The arms pivot about an axis parallel to the longitudinal axis of the anvil.

When the thickness of the record carrier changes, the distance between printing head and record carrier is kept constant by movement of the distance roller, which in a preferred embodiment is also used as a drive roller for transporting the record carrier.

6 Claims, 3 Drawing Figures

PRINTING DEVICE COMPRISING A DISTANCE ROLLER

BACKGROUND OF THE INVENTION

1. Field of the Invention

The invention relates to a printing device comprising a circular cylindrical anvil which is rotatable about its longitudinal axis, and a printing head which is displaceable along a guide rod parallel to the longitudinal axis of the anvil, being arranged opposite the said anvil and coupled to a displaceable distance roller which is spring-biased against the anvil and which is rotatable about a shaft which is parallel to the longitudinal axis of the anvil, the printing heat being displaced in a direction perpendicular to the longitudinal axis of the anvil by movement of the distance roller with respect to the anvil.

The invention is preferably applied in printing devices for printing characters which are composed of dot-like or line-like elements and which are produced by exerting pressure and/or impact on a record carrier. The use of the invention, however generally is advantageous for all printing devices in which a constant distance is required between the printing members and the record carrier, such as in printing devices in which alternately record carriers of varying thickness or a plurality of record carriers must be simultaneously printed. The invention is also applicable to printing devices in which the same type of record carrier is always used, because thickness variations in the record carrier itself could cause a variation of the distance between the printing members and the record carriers during printing.

2. Description of the Prior Art

In known printing device (German Patent Application No. 2,248,262 and U.S. Pat. No. 3,750,792) a so-called sensor which is spring-biased against the record carrier is used for maintaining a constant distance between the printing head and the record carrier. This sensor may be constructed as a rotatable roller (German Patent Application No. 2,248,262), or a non-rotatable sensor which slides over the record carrier (U.S. Pat. No. 3,750,792). In both known devices, however, the sensor is coupled to a printing head which is displaceable in a direction perpendicular to the longitudinal axis of the anvil and which accommodates the printing members. The printing head is arranged on a carriage which itself is movable in a direction parallel to the longitudinal axis of the anvil.

Such known devices have the drawback that a comparatively large mass must be quickly displaced in a direction parallel to the longitudinal axis of the anvil, because a transverse guide for the printing head separation distance must be provided on the carriage. This imposes restrictions as regards the printing speed, notably for printing devices comprising an intermittently moving carriage.

SUMMARY OF THE INVENTION

The object of the invention is to eliminate the longitudinally movable transverse guide. According to the invention the guide rod is rotatable parallel to itself about pivot areas parallel to the longitudinal axis of the anvil and is coupled to the distance roller for this purpose by way of pivotable arms.

A preferred embodiment of the device according to the invention will be described in detail hereinafter with reference to the drawing.

DESCRIPTION OF THE PREFERRED EMBODIMENT

Figure 1:
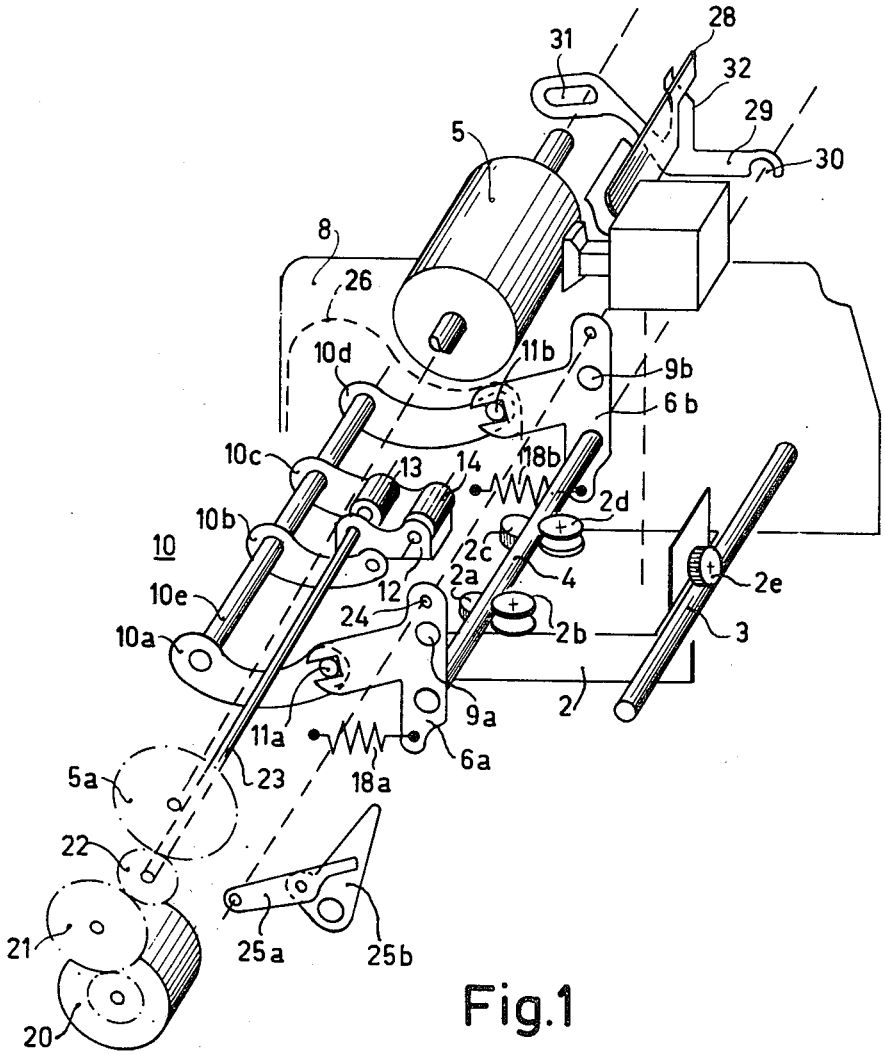
FIG. 1 is a diagrammatic exploded view of the components of a matrix printer according to the invention.

FIG. 1 shows a printing head 1, for example a matrix printing head comprising printing wires, which is arranged on a carriage 2 which is guided, by way of wheels 2*e*, on a shaft 3 and which is displaceable along a guide rod or shaft 4 by way of the wheel pairs 2*a*, 2*b* and 2*c*, 2*d*. The printer comprises a rotatable, circular cylindrical anvil 5 having a longitudinal axis parallel to the shaft 3 and the guide rod 4. The shaft 3 is rigidly connected to two frame plates, the farthest plate 8 being shown in the drawing. The guide rod 4 is supported by two pivotable arms 6*a*, *b* which are T-shaped and which are rotatably journalled in the frame plates 8 at the pivot areas 9*a* and 9*b*, respectively, the arms enabling the guide rod 4 to be moved towards and away from the anvil 5. The guide rod 4 is displaced parallel to itself during these movements. Due to the actually small displacements, the movements of the guide rod 4 and hence the movements of the printing head 1 are substantially translatory. The pivotable arms 6*a*, *b* and hence also the printing head are biased in the direction of the anvil 5 by means of springs 18*a*, *b*.

The pivotable arms 6*a*, *b* are pivotably connected to the free ends of further pivotable arms 10*a* and 10*b*, respectively, of a toggle device 10. The connection between the pivotable arms 6*a*, *b* and 10*a*, *b* is reailized by means of eccentrics 11*a*, *b* which are displaced by rotation is slots in the pivotable arms 6*a*, *b* and which enable manual adjustment of a given printing distance between printing head and paper. The toggle device 10 furthermore comprises a coupling rod 10*e* which is rotatably journalled in the frame plates 8 and which extends parallel to the longitudinal axis of the anvil 5. The toggle device 10 also comprises two central support arms 10*c*, *d* the free ends thereof being rotatably connected to a cradle-like member of candle 12. The cradle 12 comprises two rotatable distance rollers 13 and 14, the axes of rotation of the cradle 12 and the rollers 13 and 14 being parallel to the longitudinal axis of the anvil 5. The rollers 13 and 14 are pressed against the paper by means of the tensile springs 18*a*, *b* connected to the pivotable arms 6*a*, *b*. The roller 13 has a diameter which can be continuously adjusted and serves for the paper transport as will be described hereinafter with reference to FIG. 3.

The paper is fed by means of a step motor 20 which drives the roller 13 as well as the anvil 5 via the gearwheels 21, 22 and 5*a*, respectively. The gearwheel 22 is coupled, via the shaft 23, to the roller 23 and, via the gearwheel 5*a*, to the anvil 5.

The T-shaped pivotable arm 6*a* comprises a bored hole 24. At the area of the hole 24, the pivotable arm 6*a* is pivotably connected to a control arm 25*b*. When the control arm 25*b* is moved forwards in the direction of the anvil 5, the pivotable arm 6*a* is rotated against the force of the springs 18*a, b,* with the result that the rollers 13 and 14 and the printing head 1 are moved away from the anvil 5, thus allowing the introduction of paper. The path of the paper is defined by a guide plate which is shaped as denoted by the broken line 26. The guide plate extends along the full length of the anvil and has an opening, through which the rollers 13 and 14 can press against the anvil.

FIG. 1 also shows a strip-like ruler 28 which has a length which substantially corresponds to that of the anvil 5 and which presses the paper against the anvil. When the paper path is released by means of the control arm 25*b*, the ruler 28 is moved away from the anvil 5 by means of two support arms 29, only one of which is shown. Each of the support arms 29 is connected on one end to the guide rod 4 by way of a connection 30 which is denoted only by a reference, the other end of each support arm being provided with a slot-like guide 31 for a pin (not shown) on the frame plate 8. The support arms 29 are furthermore provided with a projection 32 which is directed upwards. When the control arm 25*b* is turned towards the anvil 5, the shaft 4 of the anvil 5 is moved, thus taking along the support arms 29 in the same direction, while the arms in turn move the ruler 28 away from the anvil 5 by means of their projections 32.

The operation of the printing device is as follows. A given printing distance of the printing head 1 is manually adjusted by means of the eccentrics 11*a, b.* This printing distance is maintained during printing for each paper thickness, the paper thickness being sensed by the distance rollers 13 and 14 which are displaced in the vertical direction as the paper thickness changes. These movements are transferred to the guide rod 4 at a transmission ratio 1/1 by means of the toggle device 10 and the arms 6*a, b.* The lengths of the pivotable arms 6*a, b,* the pivotable arms 10*a, b* and the support arms 10*c, d* are chosen such that said ratio of 1/1 is achieved. Via the carriage 2, the guide rod 4 provides a corresponding horizontal displacement of the printing head 1 in the direction towards or away from the anvil 5.

Figure 2:
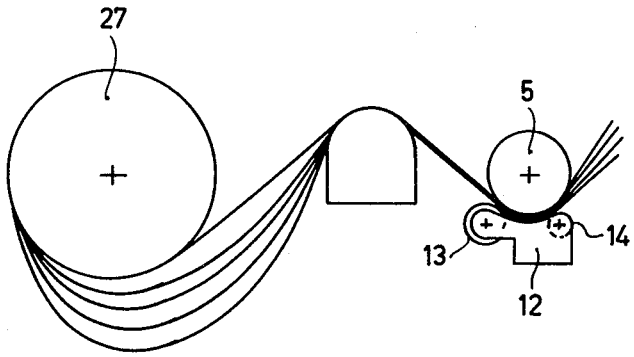
FIG. 2 shows the paper path in such a printer.

FIG. 2 diagrammatically illustrates a problem which occurs when copies are printed. When the printing device is used in telex apparatus, the number of copies may be as high as three, so that four layers of paper and three intermediate carbon paper layers are present. A stack of this kind can have a thickness such that loops appear in the various paper layers, the loops increasing in size as the layer is situated further outwards. These loops should be partly maintained and in proportion to each other, i.e., the outer layer should continue to have the longest length across the path between the paper roller 27 and the distance roller 13. Overcompression of the outer loop would cause creasing of the inner layers. The importance of this problem may be seen from the fact that a stack of paper which is normally used in telex apparatus consists of seven layers having a total thickness of 0.41 mm, and is stored in lenghts of approximately 30 m; this results in a largest loop of about 230 mm when the paper is transported in the described manner.

For some applications of printing devices it is necessary, in view of lack of space, to control the loop which occurs when the paper is unwound from the roller 27. In the printing device shown in FIG. 1 this is achieved by shaping the roller 13, also serving for transporting the paper, in a manner described below.

Via the gearwheel transmission 21, 22 shown in FIG. 1, a circumferential speed can be imparted to the roller 13 which is slightly higher than the circumferential speed of the anvil 5, with the result that the outer paper layer is transported faster than the inner paper layer, and due to the frictional forces occuring between them, the intermediate paper layers are speeded to a successively decreasing degree, so that looping is counteracted.

The loops can in principle be reduced by sensing the continuously decreasing diameter of the paper roller 27 and by successively increasing the circumferential speed of the roller 13 in accordance therewith. However, a technical solution is then required which is complex and unreliable and therefore is not desirable for many applications.

The solution described with reference to FIG. 1 can be advantageously used, the roller 13 having a given circumferential speed due to suitable proportioning of the gearwheels of the transmission of the motor 20 and the diameter of the roller 13. The dimensional accuracy of the roller 13 must satisfy very severe requirements. When the described paper having a length of 30 m is used, an increase in the diameter of the roller 13 from 16.0 to 16.1 mm already results in a difference of approximately 188 mm between the outer and the inner layer of the paper; this difference must be related to the said loop of 230 mm. The problem is increased by the face that the roller 13 is subject to wear during operation.

In order to eliminate this practical and manufacturing-technical problem, one of the distance rollers (the roller 13 in the embodiment shown in FIG. 3) is constructed as follows.

The roller 13 comprises a ring 13*a* of an elastic material and a hub 13*b* whereon the ring 13*a* is arranged. One end of the hub 13*b* is connected to the shaft 23. The roller 13 furthermore comprises a plate 13*c* which contacts the ring 13*a*, an adjusting nut 13*d* which contacts the plate 13*c*, and a locking nut 13*e*. When the nut 13*d* is tightened, the ring 13*a* is compressed, with the result that is expands radially. Subsequently, the nut 13*d* is locked by means of the nut 13*e*. The diameter of the roller 13 can thus be simply adjusted to compensate for wear, while adaptation to different paper thickness is also readily obtained.

Figure 3:
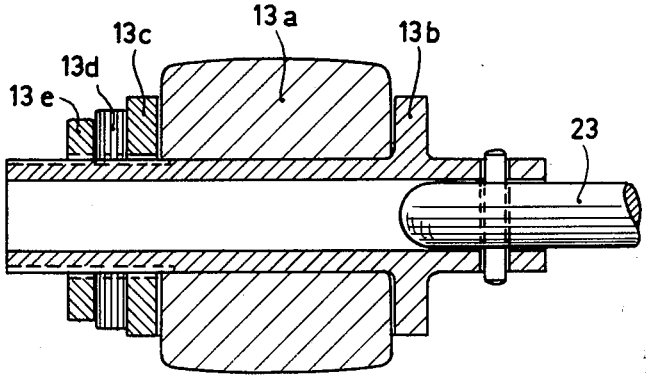
FIG. 3 is an axial sectional view of a distance roller which has an adjustable diameter and which also serves as a drive roller.

Even though, the invention has been described with reference to a preferred embodiment as shown in the FIGS. 1, 2 and 3, the invention is not restricted to printing devices in which the distance roller also serves as a feed roller for the paper. It is possible to use separate drive means for the paper and to use the distance roller exclusively for automatically controlling the printing distance.

What is claimed is:

1. A printing device comprising a circular cylindrical anvil rotatable about its longitudinal axis, an elongated guide rod mounted parallel to said longitudinal axis, a printing head disposed opposite said anvil and mounted for displacement along said guide rod, a shaft mounted parallel to said longitudinal axis, a distance roller mounted for rotation about said shaft, spring means for biasing said roller against said anvil, and means for displacing said printing head perpendicular to said longitudinal axis responsive to movement of said distance roller with respect to said anvil, wherein said means for displacing comprises pivot means for mounting said guide rod for motion with respect to said longitudinal axis, said pivot means comprising at least two arms mounted for pivotal movement about an axis parallel to said longitudinal axis, and link means for pivoting said arms in response to the position of said distance roller with respect to said longitudinal axis.

2. A device as claimed in claim 1, comprising a frame, and wherein said pivot means comprises means for mounting said arms to said frame for pivotal movement only about an axis parallel to said longitudinal axis, said guide rod being connected near each of its ends to said arms for pivotal motion therewith, and said links means comprises a coupling rod mounted for pivotal motion about an axis parallel to said longitudinal axis, a support arm connected to said coupling rod for pivotal motion therewith and having a cradle pivotally connected to the support remote from said coupling rod for movement about an axis parallel to said longitudinal axis, two distance rollers being rotatably mounted about parallel axes in said cradle, pivotal connection to said support arm being intermediate the roller rotational axes.

3. A device as claimed in claim 2, comprising in addition a motor drive for transporting a record carrier placeable between the distance rollers and the anvil, one of said distance rollers being operatively coupled to the motor drive for rotation of the roller.

4. A device as claimed in claim 2, comprising in addition a pressure strip extending parallel to said longitudinal axis and adapted to press a record carrier against the anvil, and pivotable arm means for coupling said pressure strip to the guide rod near each end of the guide rod for movement therewith perpendicular to the anvil.

5. A device as claimed in claim 1, comprising in addition a motor drive and means for operatively coupling said motor drive to the distance roller for transporting a record carrier placed between the distance roller and the anvil during printing.

6. A device as claimed in claim 5, wherein said distance roller comprises means for adjusting its diameter, and a roller portion made of an elastic material, said adjusting means comprising a shaft about which said roller rotates and having a flange, and a member on said shaft adapted for adjustable axial positioning from said flange, said elastic material being placed about said shaft between said flange and said adjusting member.

* * * * *